US006757512B2

(12) United States Patent
Miyawaki et al.

(10) Patent No.: US 6,757,512 B2
(45) Date of Patent: Jun. 29, 2004

(54) TANDEM IMAGE FORMING DEVICE, IMAGE FORMING APPARATUS AND METHOD FOR USING THE SAME

(75) Inventors: Katsuaki Miyawaki, Yokohama (JP); Takeshi Iijima, Yokohama (JP); Yusuke Takeda, Yokohama (JP); Shuji Hirai, Ota-ku (JP); Sadayuki Iwai, Yokohama (JP); Hideki Kosugi, Yokohama (JP); Makoto Obu, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/951,510

(22) Filed: Sep. 14, 2001

(65) Prior Publication Data

US 2002/0031379 A1 Mar. 14, 2002

(30) Foreign Application Priority Data

Sep. 14, 2000 (JP) ..... 2000-279143
Apr. 18, 2001 (JP) ..... 2001-119381

(51) Int. Cl.[7] ..... G03G 15/01
(52) U.S. Cl. ..... 399/299; 399/302; 399/308
(58) Field of Search ..... 399/299, 302, 399/303, 308

(56) References Cited

U.S. PATENT DOCUMENTS

| | | | | |
|---|---|---|---|---|
| 4,870,466 A | * | 9/1989 | Iida | 399/129 |
| 5,051,760 A | | 9/1991 | Shoji et al. | 347/55 |
| 5,166,739 A | | 11/1992 | Katsuki et al. | 399/401 |
| 5,208,612 A | | 5/1993 | Obu et al. | 399/361 |
| 5,300,952 A | | 4/1994 | Wada et al. | 347/217 |
| 5,493,365 A | | 2/1996 | Matsui et al. | 399/130 X |
| 5,504,590 A | | 4/1996 | Kawada et al. | 358/403 |
| 5,581,336 A | * | 12/1996 | Matsuzaki et al. | 399/270 |
| 5,610,725 A | | 3/1997 | Kawada et al. | 358/403 |
| 5,778,294 A | * | 7/1998 | Hiraoka et al. | 399/329 |
| 5,809,388 A | | 9/1998 | Inada et al. | 399/320 |
| 5,848,329 A | | 12/1998 | Aoyama et al. | 399/113 |
| 5,864,737 A | | 1/1999 | Obu et al. | 399/176 |
| 5,923,930 A | | 7/1999 | Tsukamoto et al. | 399/237 |
| 5,937,247 A | | 8/1999 | Takeuchi et al. | 399/237 |
| 5,987,281 A | | 11/1999 | Kurotori et al. | 399/237 |
| 5,999,779 A | | 12/1999 | Takeuchi | 399/239 |
| 6,038,421 A | | 3/2000 | Yoshino et al. | 399/239 |
| 6,055,390 A | | 4/2000 | Kurotaka et al. | 399/69 |
| 6,061,540 A | | 5/2000 | Takeda | 399/237 |
| 6,078,766 A | | 6/2000 | Kurotaka | 399/165 |
| 6,088,558 A | | 7/2000 | Yamada et al. | 399/165 |
| 6,108,508 A | | 8/2000 | Takeuchi et al. | 399/238 |
| 6,108,510 A | * | 8/2000 | Nakane | 399/303 |
| 6,108,906 A | | 8/2000 | Fujita et al. | 399/330 X |

(List continued on next page.)

FOREIGN PATENT DOCUMENTS

| | | |
|---|---|---|
| JP | 9-160471 | 6/1997 |
| JP | 9-269641 | 10/1997 |
| JP | 2000-235311 | 8/2000 |

*Primary Examiner*—Fred L. Braun
(74) *Attorney, Agent, or Firm*—Oblon, Spivak, McClelland, Maier & Neustadt, P.C.

(57) ABSTRACT

A tandem image forming device and method for an image forming apparatus includes a plurality of image forming sections arranged side by side along an intermediate image transfer belt. The image forming sections each include a developing device and a cleaning device arranged around an image carrier. One of nearby image forming sections has its cleaning device positioned above the developing device of the other image forming sections, e.g., an agitating section forming part of the image forming section. This configuration ensures smooth circulation of developer and therefore obviates an irregular developer distribution while reducing the overall size of the image forming device.

61 Claims, 8 Drawing Sheets

U.S. PATENT DOCUMENTS 6,115,576 A 9/2000 Nakano et al. ..... 399/302
6,122,479 A 9/2000 Fujita et al. ..... 399/333
6,131,001 A 10/2000 Tsukamoto et al. ..... 399/57
6,134,394 A 10/2000 Tsukamoto et al. ..... 399/30
6,154,624 A 11/2000 Sasaki et al. ..... 399/250
6,198,888 B1 3/2001 Kurotaka et al. ..... 399/69
6,236,825 B1 5/2001 Takeuchi ..... 399/237
6,243,559 B1 6/2001 Kurotaka et al. ..... 399/329
6,259,880 B1 * 7/2001 Jia et al. ..... 399/302 X
6,262,787 B1 7/2001 Kamoi et al. ..... 349/96
6,295,435 B1 9/2001 Shinohara et al. ..... 399/301
6,308,027 B1 10/2001 Obu et al. ..... 399/110
6,321,059 B1 * 11/2001 Tamura ..... 399/302 X
6,324,374 B1 * 11/2001 Sasamoto et al. ..... 399/302 X
6,327,458 B1 * 12/2001 Chapman ..... 399/302 X
6,336,026 B1 * 1/2002 Heeks et al. ..... 399/302
6,347,212 B1 2/2002 Kosugi et al. ..... 399/348
6,366,751 B1 4/2002 Shakuto et al. ..... 399/159
6,385,428 B1 * 5/2002 Uchida et al. ..... 399/302 X
6,389,260 B1 * 5/2002 Kataoka et al. ..... 399/302 X
6,405,008 B1 6/2002 Obu et al. ..... 399/237
6,493,533 B1 * 12/2002 Munakata ..... 399/303 X

* cited by examiner

TANDEM IMAGE FORMING DEVICE, IMAGE FORMING APPARATUS AND METHOD FOR USING THE SAME

BACKGROUND OF THE INVENTION

1. Field of the Invention

The present invention relates to a tandem image forming device including a plurality of image forming means, each of which forms a toner image on a respective image carrier, arranged side by side along an intermediate image transfer body implemented as a belt or along a path for conveying a paper sheet or similar recording medium. Also, the present invention relates to a copier, printer, facsimile apparatus or similar color image forming apparatus including a tandem image forming device.

2. Discussion of the Background

A tandem image forming device includes a plurality of image forming means arranged side by side and each including a charger, an exposing device, a developing device and a cleaning device arranged around an image carrier. Japanese Patent Laid-open Publication No. 9-34205, for example, discloses a color image forming apparatus in which a plurality of image forming means are simply arranged side by side along a path for conveying a paper sheet, OHP (OverHead Projector) film or similar recording medium. Each image forming means electrophotographically forms a toner image in a particular color. Such toner images are sequentially transferred to, e.g., a paper sheet one above the other, completing a composite color image. This kind of apparatus, however, has a problem that the distance between nearby image forming means and therefore the overall size of the apparatus increases.

In light of the above, Japanese Patent Laid-Open Publication No. 9-160471, for example, teaches a tandem image forming device in which one of nearby image forming means has its developing device positioned above a cleaning device included in the other image forming-device. Specifically, a developing device included in each image forming device uses a toner and carrier mixture, i.e., a two-ingredient type developer and is made up of an agitating section and a developing section. The agitating section conveys the developer while agitating the developer to thereby deposit the developer on a sleeve for development. The developing section transfers the toner of the developer from the sleeve to an image carrier. The agitating section is positioned at a higher level than the developing section. The cleaning device of the image forming means next to the above developing means is positioned below the above agitating section.

The tandem image forming device taught in the above Laid-Open Publication No. 9-160471 successfully reduces the distance between nearby image forming means and is therefore small size. Such an image forming device reduces the overall size of the image forming apparatus. However, the developer fed from the agitating section to the developing section, which is lower in level than the agitating section, accumulates on the sleeve. Moreover, after development, the developer accumulated on the sleeve must be returned to the agitating section against gravity and therefore cannot be smoothly circulated or uniformly mixed in the agitating section. Consequently, when the same image pattern is repeatedly output, the consumption of the toner differs from one position to another position, resulting in irregular image density.

Technologies relating to the present invention are also disclosed in, e.g., Japanese Patent Laid-Open Publication Nos. 9-269641 and 2000-235311.

SUMMARY OF THE INVENTION

It is a first object of the present invention to provide a small size, tandem image forming device capable of preventing a developer from accumulating on a sleeve, promoting smooth circulation of the developer to thereby obviate irregular image density, and reducing a distance between nearby image forming means, and an image forming apparatus including the same and transferring images from the image forming device to a recording medium by way of an intermediate image transfer body.

It is a second object of the present invention to provide an image forming apparatus whose tandem image forming device is reduced in length to thereby further reduce the overall size of the apparatus.

It is a third object of the present invention to further reduce the overall size of an image forming apparatus by locating a cleaning device assigned to an intermediate image transfer body at a unique position.

It is a fourth object of the present invention to ensure, when image formation is interrupted due to an error with toner not contributing to image formation existing on an intermediate image transfer body, high image quality by obstructing the reverse transfer of the toner.

It is a fifth object of the present invention to achieve the fourth object with a simpler configuration.

It is a sixth object of the present invention to provide, in an image forming apparatus of the type transferring images from a tandem image forming device to a recording medium by way of an intermediate image transfer body, the transfer body with a unique configuration on in order to enhance image quality.

It is a seventh object of the present invention to effect desirable secondary image transfer even to a plain paper sheet or similar recording medium having an irregular surface without any irregular density or the expansion or contraction of a toner image.

It is an eighth object of the present invention to prevent, in an image forming apparatus of the type transferring images from a tandem image forming device to a recording medium by way of an intermediate image transfer body, a secondary image transfer device from protruding from the image forming device to thereby reduce the overall size of the apparatus.

It is a ninth object of the present invention to prevent, in an image forming apparatus of the type transferring images from a tandem image forming device to a recording medium by way of an intermediate image transfer body, a fixing device from protruding from the image forming device to thereby reduce the overall size of the apparatus.

It is a tenth object of the present invention to provide, in an image forming apparatus of the type transferring images from a tandem image forming device to a recording medium by way of an intermediate image transfer body, a secondary image transfer device with a unique configuration to thereby reduce the number of parts and cost.

It is an eleventh object of the present invention prevent, in an image forming apparatus of the type transferring images from a tandem image forming device to a recording medium byway of an intermediate image transfer body, an intermediate image transfer body from protruding from the image forming device to thereby reduce the overall size of the apparatus.

It is a twelfth object of the present invention to cancel the slip of a recording medium at the time of pickup with respect to a toner image formed on an image carrier and only roughly matching a write timing for thereby obviating the need for accurate input monitor control customary with a registration sensor.

It is a thirteenth object of the present invention to start writing at a roughly matched timing based on a time when the leading edge of a recording medium moved away from a pickup position is sensed, thereby noticeably reducing the probability of the dislocation of an image too great to be absorbed by a registration roller pair.

It is a fourteenth object of the present invention to noticeably reduce the above probability even in an image forming apparatus of the type providing a preselected distance between consecutive recording media.

It is a fifteenth object of the present invention to roughly control an image formation start timing without resorting to any special sensor and obviate the need for a priority interrupt for sheet sensing, thereby reducing a load on a controller.

It is a sixteenth object of the present invention to prevent, in an image forming apparatus of the type directly transferring images from a tandem image forming device to a recording medium, prevent a developer from accumulating on a sleeve, promote smooth circulation of the developer for thereby obviating irregular image density, and reduce a distance between nearby image forming means for thereby reducing the size of the image forming device and therefore the overall size of the apparatus.

It is a seventeenth object of the present invention to achieve the above objects in a color image forming apparatus.

It is an eighteenth object of the present invention to achieve the above objects in a bicolor image forming apparatus.

It is a nineteenth object of the present invention to facilitate the maintenance of image forming means included in an image forming apparatus.

It is a twentieth object of the present invention to prevent a developer from accumulating on a sleeve included in an image forming apparatus and promote the circulation of a developer to thereby obviate irregular image density.

It is a twenty-first object of the present invention to provide a developing device for an image forming apparatus capable of efficiently agitating a developer with a simple, low-cost configuration to thereby enhance image quality.

It is a twenty-second object at the present invention to provide a developing device for an image forming apparatus capable of freeing an image from critical granularity.

It is a twenty-third object of the present invention to provide a cleaning device for an image forming apparatus capable of exhibiting a desirable cleaning ability to thereby enhance image quality.

It is a twenty-fourth object of the present invention to reduce the size of a charger included in an image forming apparatus.

It is a twenty-fifth object of the present invention to increase a nip width in a fixing device included in an image forming apparatus for thereby enhancing a fixing ability and coping with high-speed image formation.

It is a twenty-sixth object of the present invention to prevent, in an image forming apparatus of the type including a sheet turning device, the sheet turning device from noticeably protruding from a tandem image forming device to thereby reduce the overall size of the apparatus.

It is a twenty-seventh object of the present invention to prevent, in a method of arranging a plurality of image forming means side by side in a tandem image forming device, a developer from accumulating on a sleeve, promote smooth circulation of the developer to thereby obviate irregular image density, and reduce a distance between nearby image forming means for thereby reducing the size of the image forming device and therefore the overall size of the apparatus.

In accordance with the present invention, in a tandem image forming device including a plurality of image forming sections arranged side by side and each including a developing device and a cleaning device arranged around an image carrier, one of nearby ones of the image forming sections has its cleaning device positioned above the developing device of the other image forming section.

Also, in accordance with the present invention, an image forming apparatus includes an intermediate image transfer body implemented as a belt, and a tandem image forming device including a plurality of image foaming sections arranged side by side in a direction in which the intermediate image transfer body extends. The image forming sections each includes a developing device ad a cleaning device arranged around an image carrier. One of nearby ones of the image forming sections has its cleaning device positioned above the developing device of the other image forming section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
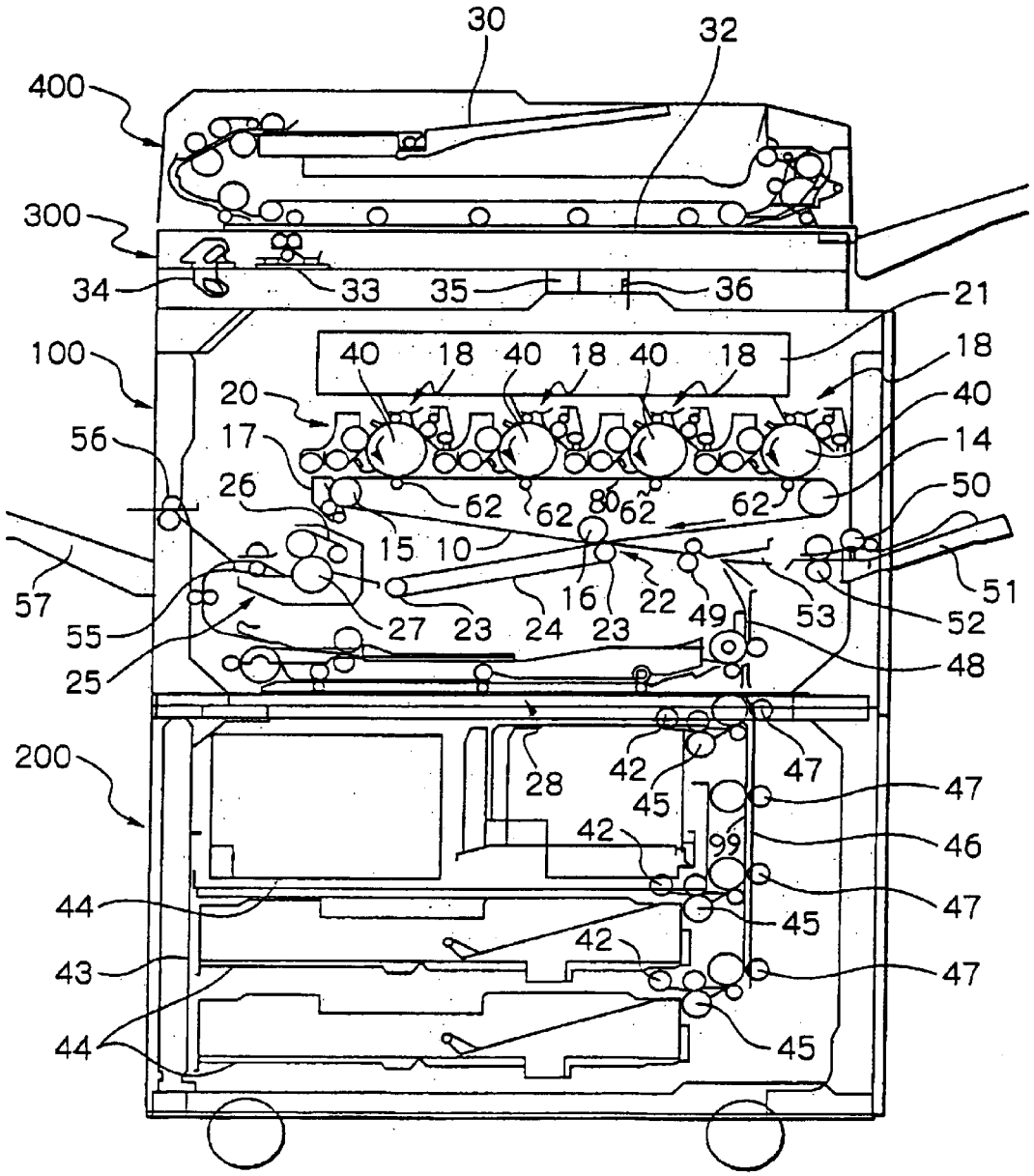
FIG. 1 is a view showing the general construction of an image forming apparatus embodying the present invention and implemented as a color copier.

Referring to FIG. 1 of the drawings, an image forming apparatus embodying the present invention is shown and implemented as a color copier by way of example. As shown, the color copier is generally made up of a copier body 100, a sheet feed table 200 on which the copier body 100 is mounted, a scanner 300 mounted on the copier body 100, and an ADF (Automatic Document Feeder) 400 mounted on the scanner 300.

Figure 2:
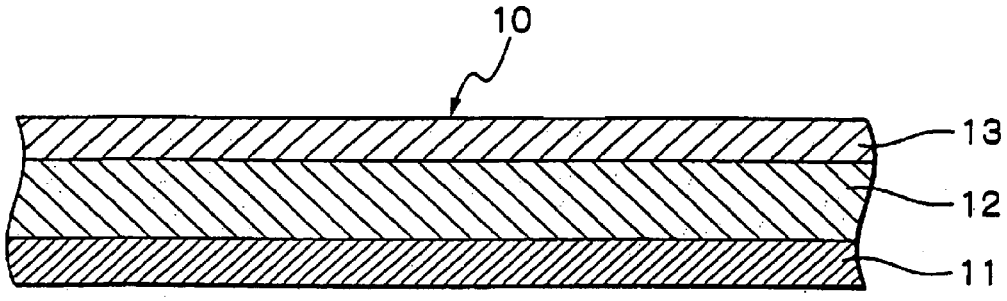
FIG. 2 is a fragmentary section showing part of an intermediate image transfer body included in the illustrative embodiment.

An intermediate image transfer body 10 is positioned at the center of the copier body 100 and implemented as an endless belt (transfer belt 10 hereinafter). As shown in FIG. 2 specifically, the transfer belt 10 is a laminate of a base layer 11, an elastic layer 12, and a coating layer 13. The base layer 11 is formed of fluorocarbon resin, canvas or similar material that stretches little. The elastic layer 12 is formed on the base layer 11 and formed of, e.g., fluororubber or acrylonitrile-butadien copolymer rubber. The coating layer 13 covering the elastic layer 13 is formed of, e.g., fluorine-containing resin.

As shown in FIG. 1, the transfer belt 10 is passed over three rollers 14, 15 and 16 and turns in a clockwise direction. In the illustrative embodiment, a belt cleaner or cleaning device 17 is positioned at the left-hand side of the roller 15 for removing toner left on the transfer belt 10 after image transfer.

Figure 3:
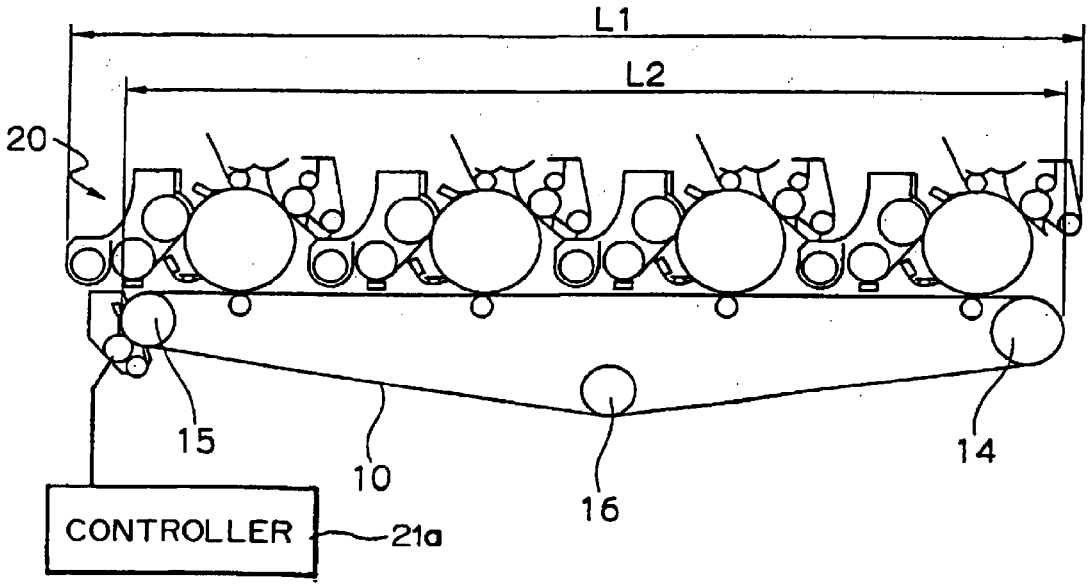
FIG. 3 is a fragmentary view of the illustrative embodiment.

Four image forming means 18 are arranged side by side above and along the upper, substantially horizontal run of the transfer belt 10 between the rollers 14 and 15, constituting a tandem image forming device. The image forming means 18 are respectively assigned to black, cyan, magenta and yellow. As shown in FIG. 3, the transfer belt 10 has a length L2 between the rollers 14 and 15 that is smaller than a length L1 over which the image forming device 20 is arranged.

As shown in FIG. 1, an exposing unit 21 is positioned above the image farming device 20.

A secondary image transferring device 22 is arranged below the lower run of the transfer belt 10 and includes an endless, secondary image transfer belt (secondary transfer belt hereinafter) 24. The secondary transfer belt 24 is passed over two rollers 23 and pressed against the roller 16.

A fixing device 25 is positioned at one side of the secondary image transferring device 22 for fixing a toner image on a paper sheet or similar recording medium. The fixing device 25 includes an endless belt 26 and a press roller 27 pressed against the belt 26. In the illustrative embodiment, the fixing device 25 is partly positioned below the lower run of the transfer belt 10 although the entire fixing device 25 may be so positioned.

The secondary image transferring device 22 additionally functions to convey the paper sheet to the fixing device 25 after image transfer. The secondary image transferring device 22 may, of course, be implemented as a charger that does not contact the transfer belt 10. With a charger, however, it is difficult to implement the sheet conveying function.

A turning device 28 is positioned below the secondary image transferring device 22 and fixing device 25 in order to turn the paper sheet upside down in a duplex copy mode. The turning device 28 extends in parallel to the tandem image forming device 20.

In operation, the operator of the color copier sets a document on a document tray 30 included in the ADF 400 or opens the ADF 400, sets a document on a glass platen 32 included in the scanner 300, and then closes the ADF 400. Assume that the operator has set a document on the document tray 30 of the ADF 400. Then, when the operator pushes a start switch, not shown, the ADF 400 conveys the document to the glass platen 32. Subsequently, a first and a second carriage 33 and 34 included in the scanner 300 are driven. While the first carriage 33 illuminates the document with a light source, the resulting reflection from the document is incident to a mirror included in the second carriage 34. The mirror reflects the incident imagewise light to an image sensor via a lens 35.

On the turn-on of the start switch, a drive motor, not shown, drives one of the rollers 14 through 16 to thereby cause the transfer belt 10 to turn. At the same time, each image forming means 18 rotates a respective image carrier 40, so that a black, cyan, magenta or yellow image is formed on the image carrier 40. The images respectively formed by the four image forming means 18 are sequentially transferred to the transfer belt 10 one above the other in accordance with the rotation of the belt 10, completing a full-color image on the belt 10. Let this image transfer be referred to as primary image transfer. In the illustrative embodiment, the image carriers are implemented as photoconductive drums by way or example.

Further, on the turn-on of the start switch, one of pickup rollers 42 disposed in the paper teed table 200 is driven to pay out a paper sheet from associated one of a plurality of sheet cassettes 44. A separator roller 45 separates paper sheets underlying the top paper sheet from the top paper sheet and conveys the top paper sheet to a sheet conveyance path 46. Rollers 47 sequentially arranged on the path 46 convey the paper sheet to a sheet conveyance path 48 arranged in the copier body 100, causing the paper sheet to abut against a registration roller pair 49. On the other hand, assume that the operator stacks, e.g., paper sheets on a manual feed tray 51. Then, a pickup roller 50 is rotated to pay out the top paper sheet while a separator roller 52 separates paper sheets underlying the top paper sheet from the top paper sheet. This paper sheet also abuts against the registration roller pair 49.

In any case, the registration roller pair 49 starts conveying the paper sheet in synchronism with the rotation of the transfer belt 10, which carries the full-color image thereon. The secondary image transferring device 22 transfers the full-color image from the transfer belt 10 to the paper sheet. This image transfer will be referred to as secondary image transfer. More specifically, a negative bias voltage of about −800 V to −2000 V, for example, is applied to the reverse side of the paper sheet while a pressure about 50N/cm$^2$, for example, is exerted on the same. As a result, toner forming the full-color image is attracted toward the paper sheet away from the transfer belt 10 and transferred to the paper sheet.

The secondary image transferring device 22 conveys the paper sheet carrying the toner image to the fixing device 25. The fixing device 25 fixes the toner image on the paper sheet with heat and pressure. In a simplex copy mode, a path selector 55 steers the paper sheet toward an outlet roller pair 56, so that the paper sheet is driven out to a copy tray 57 via the roller pair 56. In a duplex copy mode, the path selector 55 steers the paper sheet into the turning device 28. The turning device 28 turns the paper sheet upside down and again delivers it to the secondary image transfer position. After a toner image has been formed on the reverse side of the same paper sheet, the outlet roller pair 56 drives the paper sheet to the copy tray 57.

After the image transfer, the belt cleaner 17 removes the toner left on the transfer belt 10 to thereby prepare it for the next image formation.

Figure 4:
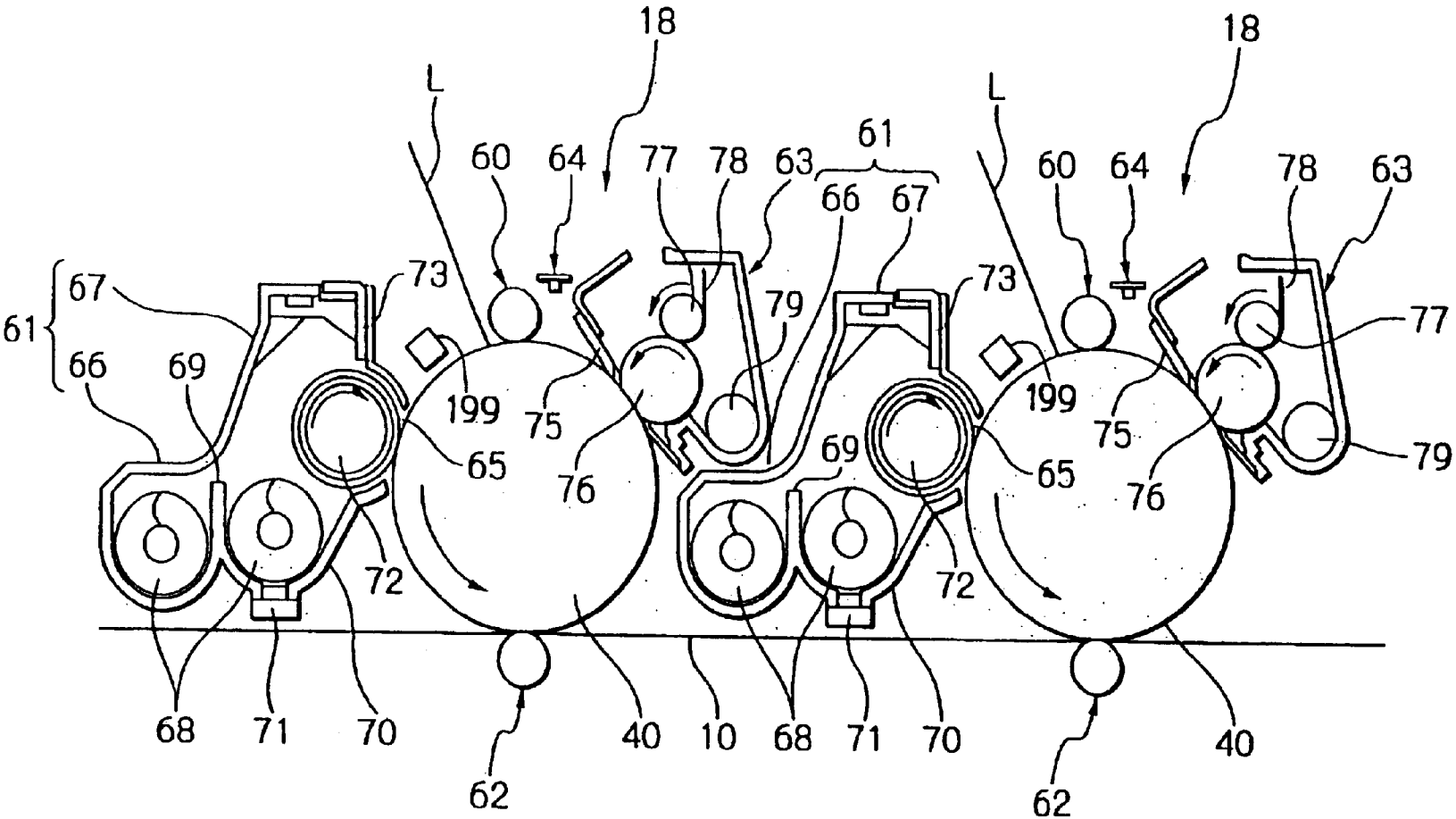
FIG. 4 is a view showing part of the configuration shown in FIG. 3.

FIG. 4 shows part of the tandem image forming device 20 in detail. As shown, each image forming means 18 includes a charger 60, a developing device 61, a primary image transferring device 62, a drum cleaner or cleaning device 63 and a discharger 64 arranged around the previously mentioned drum 40. The drum 40 may be replaced with an endless, photoconductive belt, if desired. Further, each image forming means 18 may be entirely or partly constructed into a single process cartridge that is removable from the copier body 100 for easy maintenance. In the illustrative embodiment, the charger 60 is implemented as a charge roller capable of charging the image carrier 40 in contact therewith.

In the illustrative embodiment, the developing device 61 stores a mixture of magnetic carrier and non-magnetic toner, i.e., a two-ingredient type developer. The developing device 61 is generally made up of an agitating section 66 and a developing section 67. The agitating section 66 conveys the developer while agitating the developer and deposits it on a sleeve 65. The developing section 67 transfers the developer from the sleeve 65 to the drum 40. The agitating section 66 is positioned at a lower level than the developing section 67. The agitating section 66 includes two parallel screws 68 that are isolated from each other by a partition 69 except for opposite ends thereof. A toner content sensor 71 is mounted on a case 70 for sensing the toner content of the developer. The sleeve 65 disposed in the developing section 67 faces the drum 40 via an opening formed in the case 70. A magnet roller 72 is held stationary within the sleeve 65. A doctor blade or metering member 73 adjoins the sleeve 65.

The two screws 68 circulate the developer in the case 70 while agitating the developer and feed it toward the sleeve 65. The magnet roller 72 magnetically scoops up the developer onto the sleeve 65. The developer deposits on the sleeve 65 and forms a magnet brush. While the sleeve 65 in rotation conveys the magnet brush, the doctor blade 73 regulates the height of the magnet brush. The magnet brush removed by the doctor blade 73 is returned to the agitating section 66.

The developer, i.e., toner transferred from the sleeve 65 to the drum 40 develops a latent image farmed on the drum 40 to thereby form a corresponding toner image. After the development, the developer left on the sleeve 65 leaves the sleeve 65 at a position where the magnet roller 72 does not exert any magnetic force, and also returns to the agitating section 66. When the toner content of the developer in the agitating section 66 becomes short due to repeated development, as determined by the toner content sensor 71, fresh toner is replenished to the agitating section 66.

The primary image transferring device 62 is implemented as a roller pressed against the drum 40 with the intermediary of the transfer belt 10. The roller may be replaced with a charger that does not contact the transfer belt 20, it desired.

The drum cleaner 63 includes a cleaning blade 75 formed of, e.g., polyurethane rubber and contacting the drum 40 at its edge. A conductive fur brush 76 is held in contact with the drum 40 and rotatable in a direction indicated by an arrow in FIG. 4. A metallic roller 77 is rotatable in a direction indicated by an arrow in FIG. 4 for applying a bias to the fur brush 76. A scraper 76 has its edge held in contact with the roller 77. A screw 79 collects the toner removed from the roller 77 by the scraper 78. More specifically, the fur brush 76 rotating in a direction counter to the drum 40 removes the residual toner from the drum 40. The roller 77 rotates in a direction counter to the fur brush 76 while applying the bias to the fur brush 76, thereby removing the toner from the fur brush 76. Further, the scraper 78 removes the toner from the roller 77. The screw 79 conveys the toner removed by the scraper 78 to a waste toner bottle, not shown, or returns it to the developing device 61 for reuse, as the case may be.

The discharger 64, which is implemented by a lamp by way of example, discharges the surface of the drum 40 with light so as to initialize the surface potential of the drum 40.

In operation, while the drum 40 is rotated, the charger 60 uniformly charges the surface of the drum 40. The exposing device 21 scans the charged surface of the drum 40 with light L issuing from, e.g., a laser or LEDs (Light Emitting Diodes) in accordance with the output of the scanner 300. As a result, a latent image is electrostatically formed on the drum 40.

The developing device 61 deposits toner on the latent image to thereby form a corresponding toner image on the drum 40. The primary image transferring device 62 transfers the toner image from the drum 40 to the transfer belt 10. The drum cleaner 63 removes the toner left on the drum 40 after the image transfer. Subsequently, the discharger 64 discharges the surface of the drum 40 to thereby prepare it for the next image formation.

Generally, the problem with the image forming apparatus of the type described is a sheet jam or an error occurring in the changing of the drum 40, image writing or development. In the event of a sheet jam or any error, a controller 21*a* outputs an emergency stop command in order to interrupt, e.g. the operation of drivelines and the application of the bias for primary image transfer. However, the driveline assigned to the drum 40 usually uses a flywheel and cannot therefore immediately stop operating. As a result, the drum 40 and transfer belt 10 move by about 10 mm to 20 mm each even after the generation of the emergency stop command. It follows that the toner deposited on the transfer belt 10 is apt to move to the next or downstream primary image transfer position and deposit on the drum 40 located there.

In light of the above in the event of an error, the illustrative embodiment applies a bias to the primary image transferring device 62 while generating an emergency stop command. This successfully prevents the toner from being reversely transferred from the transfer belt 10 to the unexpected drum 40 until the belt cleaner 17 removes the toner from the transfer belt 10.

In the illustrative embodiment, the image forming device 61 included in one of nearby image forming means 18 has its agitating section 66 positioned below the drum cleaner 63 of the other image forming means 18. Such an arrangement reduces the distance between the image forming devices 18 and therefore the size of the tandem image forming device 20, i.e., the overall size of the color copier. Further, the agitating section 66 of each developing means 18 is positioned at a lower level than the developing section 67. This not only prevents the developer from accumulating on the sleeve 65, but also promotes the circulation of the developer for thereby obviating irregular image density.

Control over the operation timing of the color copier will be described hereinafter. In the illustrative embodiment, a sensor, not shown, responsive to the leading edge of a paper sheet is located on either one of the paths 46 and 48. The exposure of the drum 40 begins in response to the output of the above sensor. At the same time, the registration roller pair 49, which corrects the skew of the paper sheet, starts driving the paper sheet such that the leading edge of the paper sheet meets the leading edge of a toner image formed an the drum 40.

In a repeat copy mode, a sensor, not shown, positioned on either one of the paths 46 and 48 senses the leading edge and trailing edge of a paper sheet. When the sensor senses the leading edge of a paper sheet, the exposure of the drum 40 begins on the elapse of a preselected period of time since the sensor has sensed the trailing edge of the same paper sheet, the next paper sheet begins to be fed. The registration roller pair 49 starts driving the preceding paper sheet at the same timing as described above. Alternatively, use may be made of the sensor responsive only to the leading edge of a paper sheet.

For example, the sensor described above is located in the vicinity of the outlet of each sheet cassette 44 or implemented as a jam sensor located on the path 46 or 48. The jam sensor is positioned on the sheet conveyance path at a distance greater than the distance between the exposing position and the image transferring position assigned to the drum 40. Specifically, when the sheet conveying speed increases, the illustrative embodiment controls the image forming timing in such a manner as to cancel a slip occurring at the time of sheet pickup and correct the skew of a paper sheet as well as an image position on a paper sheet.

To cancel a slip to occur at the time of sheet pickup, the illustrative embodiment uses a sheet sensor located on the path 46 or 48. The sheet sensor is not monitored with accuracy as high as a registration sensor, but is simply monitored by periodic interruption. At least one sensor for the above purpose is located on the path 46 or 48, typically just after the sheet pickup position, and functions in the same manner as a registration sensor for roughly determining the image writing timing. This is because the registration roller 49 accurately adjusts an image position on a paper sheet. At the time of sheet pickup, the slip of a paper sheet can be canceled because the image writing operation starts in response to the output of the sheet sensor. In addition, the registration roller pair 49 corrects the skew of a paper sheet.

Figure 5:
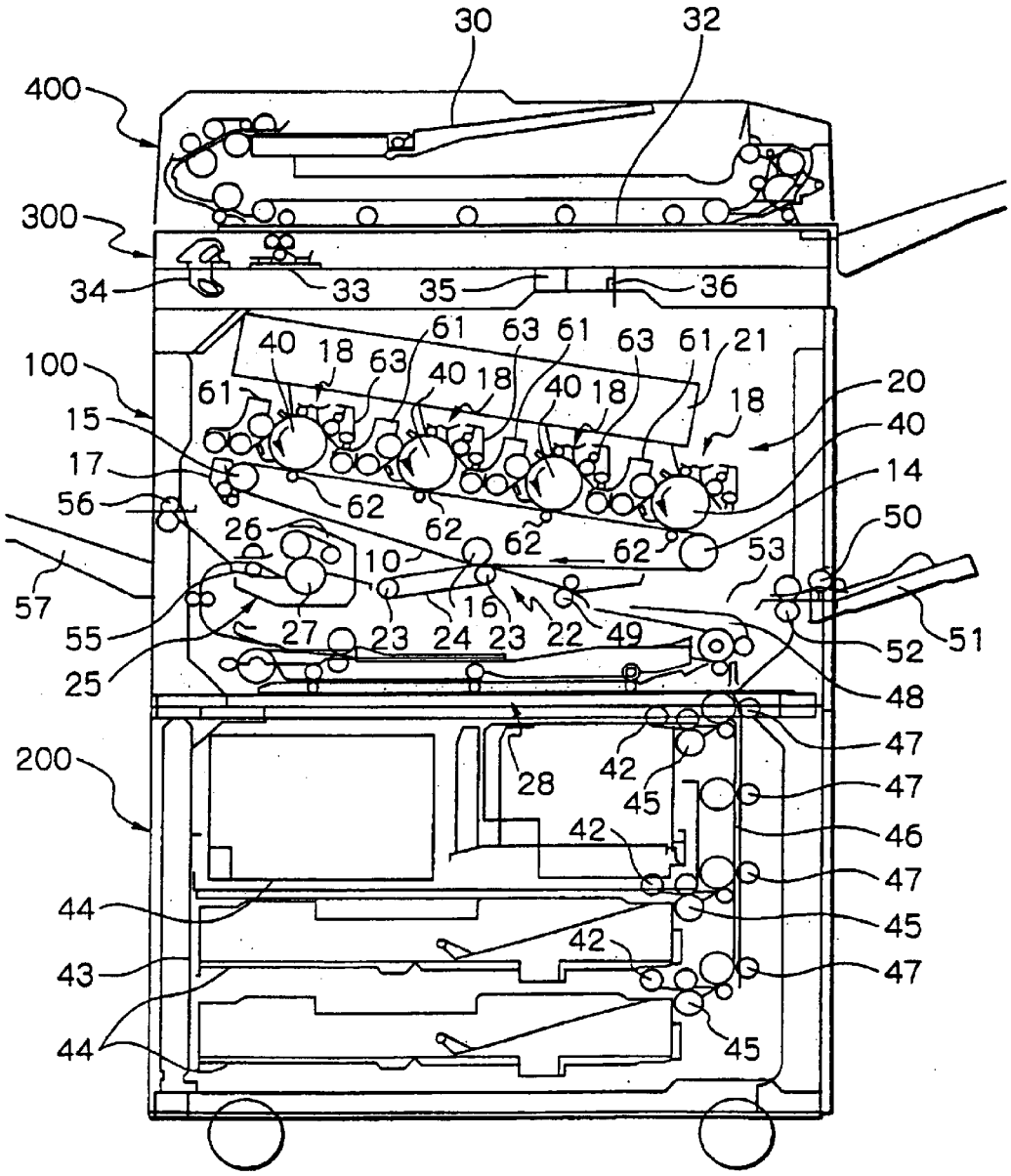
FIG. 5 is a view showing an alternative embodiment of the present invention.

Referring to FIG. 5, an alternative embodiment of the present invention will be described. As shown, in the illustrative embodiment, the transfer belt 10 is positioned slightly obliquely downward from its upstream side to its downstream side. The tandem image forming device 20 with the image forming means 18 also extends obliquely downward along the upper run of the transfer belt 10. Again, the developing device 61 of one image forming means 18 is partly positioned below the drum cleaner 63 of the other image forming means 18 adjoining it. This configuration reduces the length L of the image forming device 20 and therefore the overall size of the color copier. In the illustrative embodiment, the entire fixing device 25 is positioned below the range over which the transfer belt 10 extends. As for the rest of the configuration, this embodiment is identical with the embodiment of FIG. 1.

Figure 6:
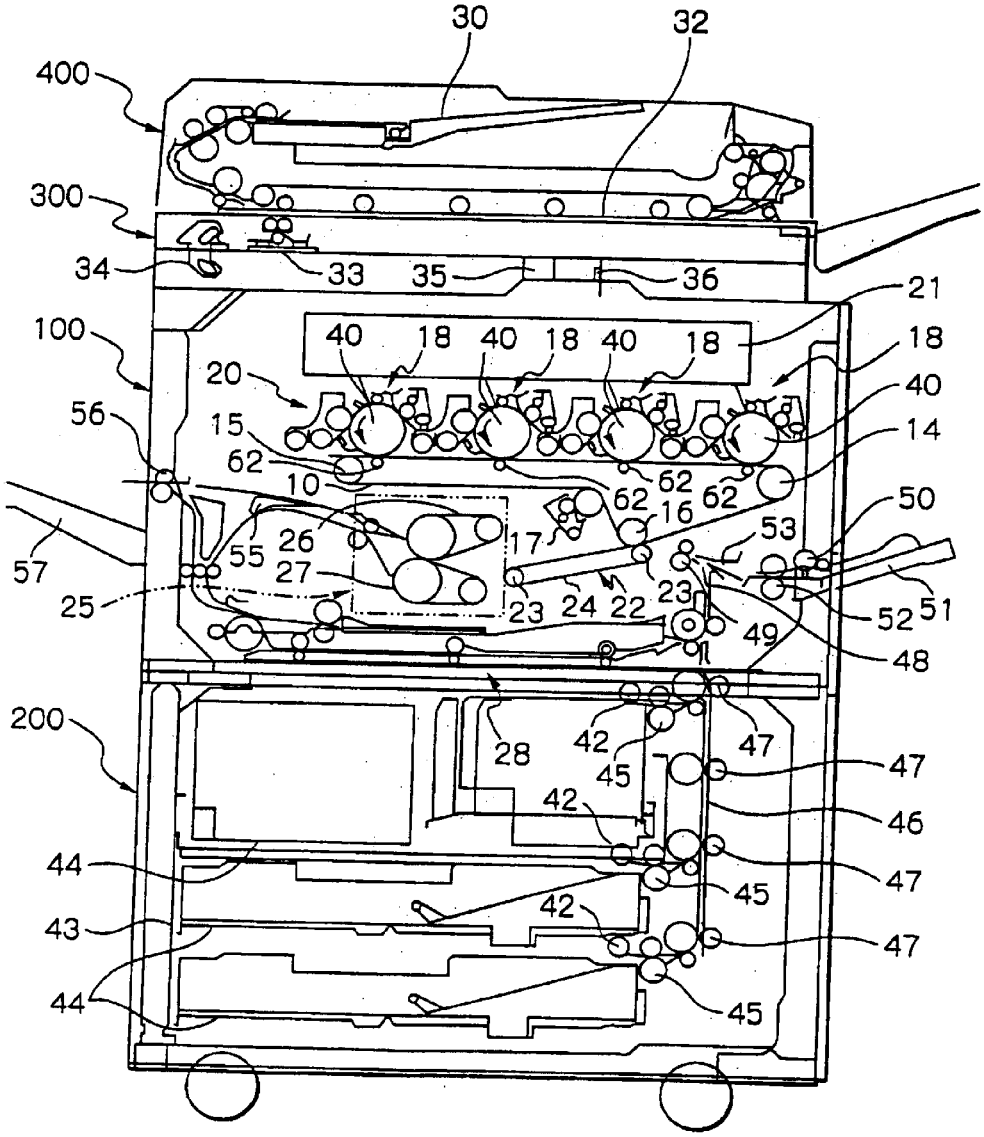
FIG. 6 is a view showing another alternative embodiment of the present invention.

FIG. 6 shows another alternative embodiment of the present invention. As shown, this embodiment differs from the embodiment shown in FIG. 1 except that the entire fixing device is positioned below the range over which the transfer belt 10 extends. This is also successful to reduce the overall size of the color copier. As for the rest of the configuration, this embodiment is also identical with the embodiment of FIG. 1.

Figure 7:
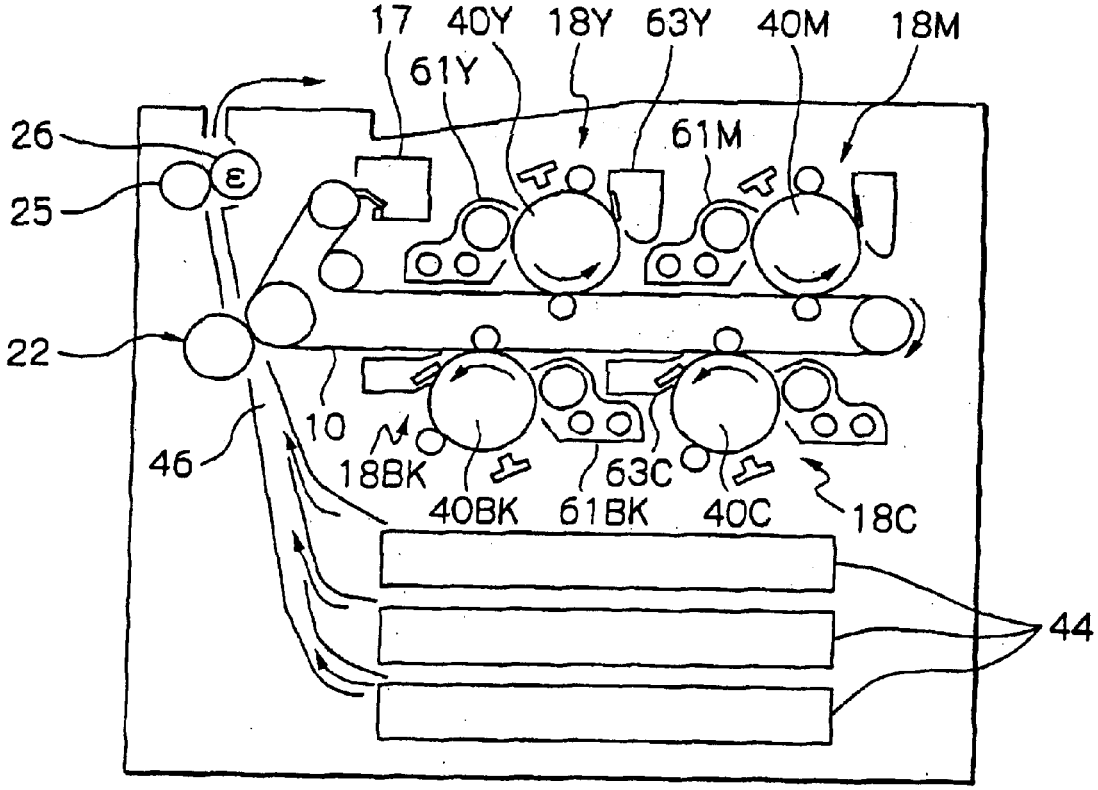
FIG. 7 is a view showing still another alternative embodiment of the present invention.

FIG. 7 shows still another alternative embodiment of the present invention. As shown, part of a plurality or developing means 18 is arranged side by side above the upper run of the transfer belt 10 while the other part of the developing means 18 is positioned side by side below the lower run of the transfer belt 10. Specifically, yellow image forming means 18Y and magenta image forming means 18M are positioned above the transfer belt 10 while cyan developing means 18C and black developing means 18BK are arranged below the transfer belt 10. Again, the developing device 18 of one developing means 18 is partly positioned below the drum cleaner 63 of the other image forming means 18 adjoining it. Alternatively, all the image forming means 18 may be arranged side by side below the transfer belt 10. As for the rest or the configuration, this embodiment is also identical with the embodiment of FIG. 1.

In the illustrative embodiment, the belt cleaner 17 is positioned above the developing device 61Y of the image forming means 18Y. This also contributes to the small size configuration of the color copier.

Figure 8:
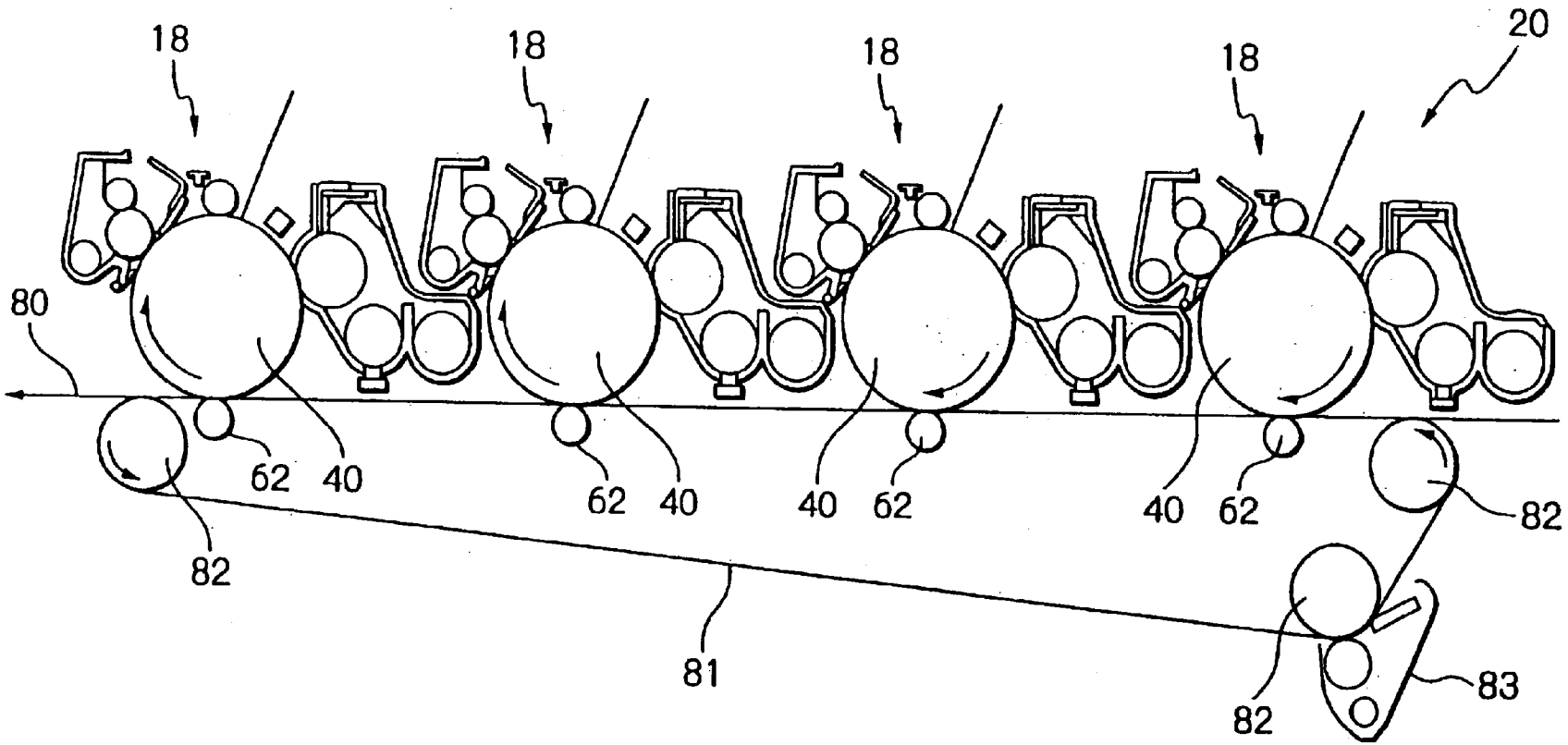
FIG. 8 is a view showing a further alternative embodiment of the present invention.

In the foregoing embodiments, a plurality of image forming means 18 each including the developing device 61 and drum cleaner 63 arranged around the drum 40 are arranged side by side in the direction in which the transfer belt 10 extends. Images formed on the drums 40 are transferred to a paper sheet by way of the transfer belt 10. FIG. 8 shows a further alternative embodiment of the present invention. As shown, the image forming means 18 are arranged side by side along a sheet conveyance path 80. In the illustrative embodiment, images formed on the drums 40 are sequentially transferred to a paper sheet one above the other without the intermediary of an intermediate image transfer body. Specifically, a belt conveyor 81 is passed over three rollers 82 and conveys the paper sheet along the sheet conveyance path 80. A belt cleaner or cleaning device 83 removes the toner left on the belt conveyor 81 after image transfer.

The illustrative embodiments have been implemented as a color copier of the type causing the image forming means 18 to form images in respective colors and transferring the resulting full-color image to a paper sheet. The illustrative embodiments are similarly applicable to a bicolor image forming apparatus including two image forming means 18 arranged side by side. Images formed by the two image forming means 18 are combined to form a bicolor image to be transferred to a paper sheet. In this case, too, the drum cleaner 63 of one image forming means 18 is positioned above the developing device 61 of the other image forming means 18.

Figure 9:
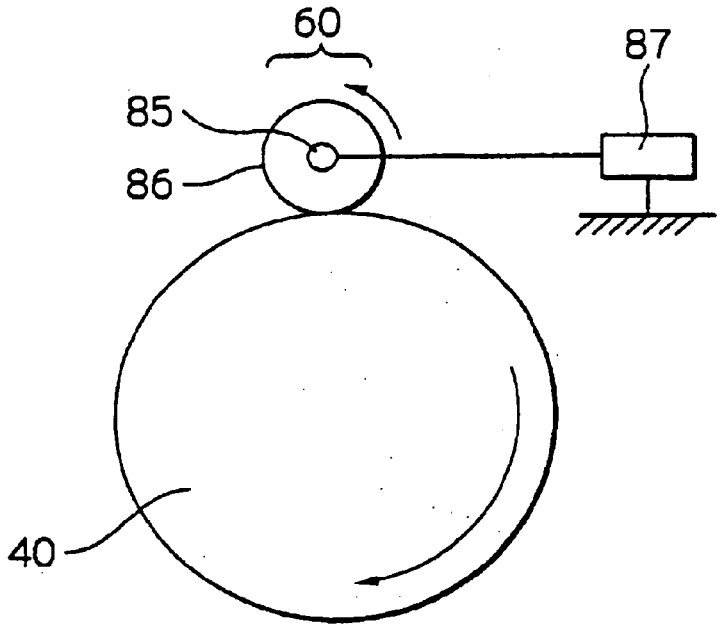
FIG. 9 is a view showing a specific configuration of a charger in accordance with the present invention.

FIG. 9 shows a specific configuration of the charger 60. As shown, the charger 60 contacts the drum 40 rotating at a preselected process speed in a direction indicated by an arrow. The charger 60 is made up of a metallic core 85 and a roller-like, conductive rubber layer 86 formed on the core 85 concentrically with the rubber layer 86. The core 85 is rotatably supported by, e.g., bearings at opposite ends thereof. Pressing means, not shown, presses the core 85 against the drum 40 with a preselected force. In the specific configuration shown in FIG. 9, the charger 60 is caused to rotate by the drum 40. The core 85 has a diameter of 9 mm while the rubber layer 86 has a diameter of 16 mm. The rubber layer 86 is formed of rubber having medium resistivity of 100,000 Ω·cm. A power supply 87 applies a preselected bias to the charger 60 so as to uniformly charge the surface of the drum 40 to a preselected potential of preselected polarity.

The charger 60 may have any suitable configuration other than a roller, e.g., a magnet brush or a fur brush matching with the specification and configuration of an image forming apparatus. A magnet brush is made up of a magnet roll, a nonmagnetic conductive sleeve accommodating the magnet roll, and Zn—Cu (zinc-copper) ferrite or similar ferrite grains supported by the sleeve. A fur brush is made up of a core formed of metal or similar conductive material and fur formed of carbon, copper sulfate, metal or provided with conductivity by a metal oxide.

Figure 10:
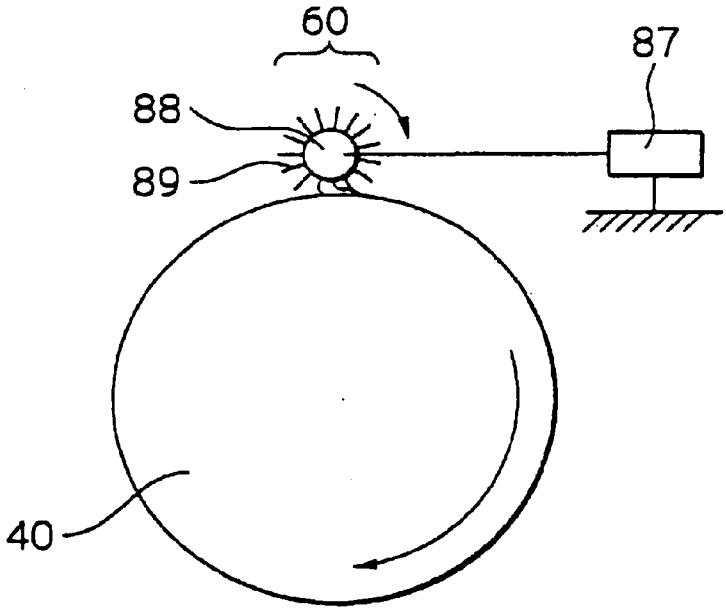
FIG. 10 is a view showing another specific configuration of the charger.

FIG. 10 shows a specific configuration of a fur brush. As shown, the drum 40 is rotated at a preselected process speed in a direction indicated by an arrow. The charger 60 is pressed against the drum 40 by a preselected pressure over a preselected nip against the elasticity of a brush portion 89. Specifically, the charger 60 includes a metallic core or electrode 88 having a diameter of 6 mm. The brush portion 89 is a pile tape implemented by conductive rayon filaments REC-B available from UNITIKA LTD. The brush portion 89 is spirally wrapped around the core 88 and forms a roll brush having an outside diameter of 14 mm and an axial length of 250 mm. The brush portion 89 has a thickness of 300 denier/50 filaments and a density of 155 filaments/mm$^2$. Such a roll brush is coupled over a pipe having an inside diameter of 12 mm while being rotated such that the brush and pipe become concentric. The brush and pipe are then left in a hot, humid atmosphere to thereby shape the filaments.

The charger 60 has a resistance of 1×105 Ω with respect to a voltage of 100 V applied. The resistance was measured in terms of a current flown through the charger 60 when 100 V was applied to the charger 60 held in contact with a metallic drum having a diameter of 30 mm over a 3 mm wide nip.

When pinholes or similar defects appear in the dorm 40, an excessive leak current flows into the defects and makes charging defective at the nip. In light of this, the resistance of the fur brush type charger 60 should be 104 Ω or above. At the same time the resistance should be 107 Ω or below so as to sufficiently inject a charge into the surface of the drum 40.

As for the material of the brush, use may alternatively be made of REC-C, REC-M1 or REC-10 also available from UNITIKA LTD., SA-7 available from TORAY INDUSTRIES, INC., Sandarlon available from NIPPON SANMO LTD., Beltlon available from KANEBO, LTD., Kracarbo (rayon with carbon dispersed therein) available from KURARAY CO., LTD. or Robal available from Mitsubishi Rayon Co., Ltd. The filaments constituting the brush should preferably be 3 denier to 10 denier thick each. Ten to a hundred filaments should preferably be bundled together. Further, the filaments are arranged in a density of 80 filaments/mm to 600 filaments/mm. In addition, the filaments should preferably be 1 mm to 10 mm long each.

The fur brush type charger 60 is rotated at a preselected peripheral speed in a direction counter to the direction of rotation of the drum 40 in contact with the drum 40. The peripheral speed of the charger 60 and that of the drum 40 are different from each other. The power supply 97 applies a preselected voltage to the charger 60 to thereby uniformly charge the surface of the dry 40. In the specific condition shown in FIG. 10, direct injection charging is predominant as to the charging of the drum 40 by the charger 60. The surface of the drum 40 is charged to a potential substantially equal to the voltage applied to the charger 60.

The charger 60 implemented by a magnet brush is also pressed against the drum 40 by a preselected pressure over a preselected nip width against the elasticity of the brush portion 89, as shown in FIG. 10 by way of example. In the specific configuration, Zu—Cu ferrite grains having a mean grain size of 25 μm and Zn—Cu ferrite grains having a mean grain size of 10 μm were mixed together in a ratio of 1:0.05 in terms of weight. The 25 m ferrite grains were coated with resin having a medium resistance. The contact type charger was made up of the above, coated magnetic grains, a nonmagnetic conductive sleeve for supporting the grains, and a magnet roller disposed in the sleeve. The coated magnetic grains coated the sleeve with a thickness of 1 mm. A charge nip of about 5 mm wide was formed between the sleeve and the image carrier 40. The sleeve and image carrier 40 were spaced from each other by a gap of about 500 μm. The magnet roller was rotated such that the sleeve surface slidingly contacts the image carrier 40 at a peripheral speed two times as high as the peripheral speed of the image carrier 40 in the opposite direction. In this condition, the magnet brush uniformly contacted the image carrier 40.

As for the developer, a weight mean diameter of 4 μm to 15 μm successfully enhances the resolution of an image. To measure a weight mean value, 0.1 ml to 5 ml of surfactant (preferably alkylbenzenesulfonate) is added to 100 ml to 150 ml of an electrolytic aqueous solution, which is about 1% NaCl aqueous solution and may be ISOTON-II available from COULTER. Subsequently, 2 mg to 20 mg of a sample to be measured is added to the above mixture. The electrolytic aqueous solution with the sample is dispersed for about 1 minutes to 3 minutes by an ultrasonic disperser. By using the previously mentioned measuring device and an aperture of 100 μm, the volume and numbers of toner grains are measured to determine a volume distribution and a number distribution. The weight mean grain size of the toner is calculated from the above distributions.

As for channels, there are used thirteen channels in total, e.g., a channel of 2.00 μm to less than 2.52 μm, a channel of 2.52 μm to less than 3.17 μm, a channel of 3.17 μm to less than 4.00 μm, a channel of 4.00 μm to less than 5.04 μm, a channel of 5.40 μm to less than 6.35 μm, a channel of 6.35 μm to less than 8.00 μm, a channel of 8.00 μm to less than 10.08 μm, a channel of 10.08 μm to less than 12.70 μm, a channel of 12.70 μm to less than 16.00 μm, a channel of 16.00 μm to less than 20.20 μm, a channel of 20.20 μm to less than 25.40 μm, a channel of 25.40 μm to less than 30.00 μm, and a channel of 32.00 μm to less than 40.30 μm.

Toner consists of 75% to 93% of binder resin, 3% to 10% of coloring agent, 3% to 8% of parting agent, and 1% to 7% of other components.

The binder resin may be any one of polystyrene, poly-p-chlorostyrene, polyvinyl toluene or similar styrene or a polymer of modifications thereof, styrene-p-chlorostyrene copolymer, styren-vinyltoluene copolymer, styrene-vinylnaphthalene copolymer, styrene-acrylic ester copolymer, styrene-metacrylic ester copolymer, styrene-α-chrlorometacrylic methyl copolymer, styrene-acrylonitrile copolymer, styrene-vinylmethyl ether copolymer, styrene-vinylethyl ether copolymer, and styrene-vinylmethyl ketone.

As for the coloring agent, use may be made of any conventional, organic or inorganic pigment or dye, e.g., carbon black, Aniline Black, Acetylene Black, Naphthol Yellow, Hansa Yellow, Rhodamine Lake, Alizarin Lake, red ion oxide, Phthalocyanine Blue or Indanthrene Blue.

As for the magnetic material, use may be made of Magnetite, γ-iron oxide, ferrite iron, excess type ferrite or similar ion oxide, iron, cobalt, nickel or similar magnetic metal or a composite metal oxide alloy or a mixture of iron oxide and any one of cobalt, tin, titanium, copper, lead, magnesium, manganese, aluminum, silicon and other metals. The magnetic grains have a mean grain size that is preferably between 0.05 μm and 1.0 μm, more preferably between 0.1 μm and 0.6 μm or even more preferably between 0.1 μm and 4 μm.

Further, the magnetic grains have a surface area that is preferably between 1 m$^2$/g and 20 m$^2$/g, more preferably between 2.5 m$^2$/g and 12 m$^2$/g, in terms of BET ratio measured by a nitrogen adsorption method. The Morse hardness of the magnetic grains should preferably range from 5 to 7. While the magnetic grains are octahedral, hexahedral, spherical, needle-like or scale-like, octahedron, hexahedron or sphere with a minimum of anisotropy is desirable. When the magnetic grains are implemented as magnetic toner, the toner grains should preferably contain 10 parts by weight to 150 parts by weight of magnetic material for 110 parts by weight of binder resin.

A trace of additive may be added to the toner of the present invention so long as it does not adversely effect the toner. The additive may be the powder of Teflon (trade name) available from Du-Pont, Zinc stearate, vinylidene polyfluoride or similar lubricant, the powder at celium oxide, silicon carbonate, strontium titanate or similar polishing material, the powder of titanium oxide, aluminum oxide or similar fluidizing material or anti-caking material, the powder of carbon black, zinc oxide, tin oxide or similar conductivity providing material, or the powder of organic or inorganic fine grains opposite in polarity to the toner.

A parting agent may also be added to the toner in order to improve fixing ability. The parting agent may be any one of paraffin wax and its derivatives, microcrystalline wax and its derivatives, Fischer-Tropsh wax and its derivatives, polyorephine wax and its derivatives, and carnauba wax and its derivatives. Derivatives include block copolymers with oxides or vinyl monomers and the grafted matters of vinyl-based monomers. Alternatively, use may be made of alcohol, fatty acid, acid amide, ester, ketone, hardened castor oil or a derivative thereof, plant wax, animal wax, mineral wax or petrolactam.

A charge control agent will be described hereinafter. A charge control agent that charges toner to negative polarity should preferably be, e.g., an organic metal complex or a chelate compound. Such a charge control agent may be selected from mono/azo metal complexes, acetylacetone metal complexes, aromatic hydroxycarbonic acid metal complexes, and aromatic dicarbonic acid metal complexes. Other charge control agents capable of charging toner to negative polarity include aromatic hydroxycarbonic acid, aromatic mono/polycarbonic acid and a metal acid, unhydride or ester thereof, and bisphenol and other phenol derivatives.

Charge control agents that charge toner to positive polarity include modifications derived from Nigrosine or fatty acid metal salt, tributhyl-1-hyhdroxy-4-naphthosulphonate, tributhylammonium tetrafluoroborate and other tetraammonium salts, phosphonium salt and other onium salts and lake pigments thereof similar to tetraammonium salts, triphenylmethane dyes and lake pigments thereof, and triphenyl methane dyes and lake pigments thereof. As for lake agents, use may be made of phosphorous tungsten acid, phosphorous molybdenum acid, phosphorous tungsten-molybudenum acid, tanninic acid, lauric acid, gallic acid, ferricyanide or ferrocyanide.

The powdery charge control agent should preferably have a number mean grain size of 4 $\mu$m or below, more preferably 3 $\mu$m or below. When each toner grain contains the charge control agent therein, the former should preferably contain the latter by 0.1 part by weight to 20 parts by weight, more preferably 0.2 part by weight to 10 parts by weight, for 100 parts by weight of binder.

The toner produced by the present invention may contain additives customarily used, e.g., coloid silica or similar fluidizing agent, titanium oxide, aluminum oxide or similar metal oxides silicone carbonate or similar polishing material, and fatty acid metal salt or similar lubricant.

The toner should preferably contain inorganic fine powder by 1 wt % to 2 wt %. A content below 1 wt % would fail to reduce the cohesion of the toner. A content above 2 wt % would cause the toner to fly about between fine lines, would contaminate the interior of an image forming apparatus, and would scratch or otherwise damage a photoconductive element.

To mix an additive with the toner, use may be made of any conventional implementation, e.g., a Henschel mixer or a speed kneader.

The toner powder kneaded and then cooled may be pulverized and then sieved, as conventional. The resulting toner for development may be implemented as toner or as toner contained in a developer together with carrier grains.

Generally, when toner and carrier are mixed together to form a two-ingredient type developer, the developer should preferably contain 0.5 parts by weight to 6.0 parts by weight of toner for 100 parts by weight of carrier. The toner of the present invention and carrier should preferably be mixed such that the toner grains deposit on 30% to 90% of the surface area of a carrier grain.

As for the core of the individual carrier grain, use maybe made of a conventional substance, e.g., iron, cobalt, nickel or similar ferromagnetic material, magnetite, hematite, ferrite or similar alloy or compound, or the composite of ferromagnetic fine grains and resin.

The carrier grains applicable to the present invention should preferably be coated with resin for enhancing durability. Such resin may be polyethylene, polypropylene, chlorinated polyethylene, polyethylene chlorosulphonate or similar polyolefine resin, polystyrene, acryl (e.g., methacrylate), polyacrylonitrile, polyvinyl acetates polyvinyl alcohol, polyvinyl butyral, vinyl polychroride, polyvinyl carbazole, polyvinyl ether or similar polyvinyl resin or polyvinylidene resin, vinyl chloride-vinyl acetate copolymer, silicone resin with organosiloxane bond or a modification thereof (e.g. derived from alkyd resin, polyester resin, epoxy resin or polyurethane resin), polytetrafluoroethylene, polyvinyl polyfluoride, vinylidene polyfluoride, polychlorotrifuloroethylene or similar fluorocarbon resin, polyamide, polyester, polyurethane, polycarbonate, urea-formaldehyde resin or similar amino resin, or epoxy resin. Among them, silicone resin or a modification thereof or fluorocarbon resin, particularly silicone resin or a modification thereof, is desirable for obviating the spending of toner. To coat the carrier cores with the above resin, a coating liquid should only be applied to the surfaces of the cores by spraying, immersion or similar conventional technology. The coating should preferably be 0.1 $\mu$m to 20 $\mu$m thick.

A specific procedure for producing a two-ingredient type developer will be described hereinafter. 100 parts by weight of polyester resin, 10 parts by weight of carbon black, 5 parts by weight of polypropylene and 2 parts by weight of tetraammonium salt were melted, kneaded and then pulverized and sieved. Polyester resin had a weight mean grain size of 300 $\mu$m and a softening point of 80.2° C. while polypropylene had a weight mean grain size of 180 $\mu$m. Further, 0.3 parts by weight of hydrophobic silica was mixed with 100 parts by weight of colored grains to thereby produce toner having a mean grain size of 9.0 $\mu$m.

2 parts by weight of polyvinyl alcohol and 60 parts by weight of water were introduced in a ball mill together with 100 parts by weight of magnetite produced by a wet process and then mixed for 12 hours, thereby preparing magnetite slurry. The slurry was granulated by spraying for thereby producing spherical grains. The grains were baked at 1,000° C. for 3 hours in a nitrogen atmosphere and then cooled to produce core grains. 100 parts by weight of silicone resin solution, 100 parts by weight of toluene, 15 parts by weight of $\gamma$-aminopropyltrimethoxysilane and 20 parts by weight of carbon black were mixed together and dispersed for 20 minutes to thereby prepare a coating liquid. 1,000 parts by weight of the above core grains were coated with the coating liquid by a fluidized bed type coater, thereby producing carrier grains coated with silicone resin. 97.5 parts by weight of carrier grains were mixed with 2.5 parts by weight of toner grains to thereby produce a two-ingredient type developer.

In summary, it will be seen that the present invention provides an image forming apparatus with a tandem image forming device having various unprecedented advantages, as enumerated below.

(1) A developer is prevented from staying on a sleeve for development and is therefore smoothly circulated to obviate an irregular distribution.

(2) The image forming device and therefore the entire image forming apparatus is reduced in size.

(3) Assume that when image formation is interrupted due to an error, toner that does not contribute to image formation is present on an intermediate image transfer body. Then, the toner is prevented from being reversely transferred from the transfer body and mixed with toner of another color. This insures high image quality.

(4) After a controller has output an emergency stop command, a bias for obstructing reverse transfer is formed without any time lag. Reverse transfer can therefore be stably obstructed just after the generation of the above command. Further, the bias is formed by existing, primary transfer bias forming means, obviating an extra cost.

(5) A smooth coating layer covering the elastic layer of the transfer body allows the transfer body to intimately contact an image carrier and thereby further enhances image quality.

(6) The transfer body is implemented by a member that is not flexible in the circumferential direction of the transfer body, but is elastic at least on its surface. Such a member is pressed at the time of secondary image transfer. Therefore, a high quality image can be transferred even to a plain paper sheet whose surface is irregular, and is not extended or contracted at all. This, coupled with the stable rotation of the transfer body, insures high image quality. This is particularly true with a color image forming apparatus.

(7) An extra member for conveying a paper sheet to a fixing unit is not necessary, so that the number of parts and cost of the apparatus are reduced.

(8) The slip of a paper sheet at the time of pickup is canceled with respect to a toner image formed on the image carrier. Further, a conventional registration sensor or similar precision sensor is not necessary.

(9) In an image forming apparatus of the type feeding paper sheets at preselected time intervals, it is natural and simple to repeat writing operation at a fixed timing in relation to sheet feed from the programming standpoint. However, a slip too great to be absorbed by a registration roller pair results in the dislocation of an image on a paper sheet. The apparatus of the present invention starts writing an image at a roughly controlled timing in response to the output of a sensor, which is responsive to the lading edge of a paper sheet moved away from a pickup position. This remarkably reduces the probability of the dislocation of an image mentioned above. This is also true with an image forming apparatus of the type providing a preselected distance between consecutive paper sheets.

(10) The above sensor is a sheet sensor adjoining the outlet of a sheet cassette. The timing can therefore be roughly controlled without resorting to a special sensor. In addition, the controller does not have to use a priority interrupt to sense a paper sheet. This is also true when the sensor is implemented by a jam sensor located on a conveyance path at a distance greater than a distance between an exposure position and an image transfer position assigned to the image carrier.

(11) Image forming means is entirely or partly constructed into a process cartridge bodily removable from the apparatus body and therefore easy to maintain.

(12) Two parallel screws are disposed in an agitating section while the sleeve for development is positioned in a developing section. Therefore, a developing device, in particular, can sufficiently mix a developer with a simple, low-cost configuration and further enhances image quality.

(13) The developer has a weight mean grain size of 4 $\mu$m to 15 $\mu$m, which is small enough to free an image from granularity.

(14) A cleaner using a cleaning blade and a fur brush surely, efficiently performs cleaning and enhances image quality.

(15) The cleaner further includes an electric field roller for applying a bias to the fur brush. This further enhances the cleaning ability of the cleaner as well as image quality.

(16) A charger applies a voltage to the image carrier in contact with the image carrier and is therefore small size.

(17) The fixing unit uses an endless belt capable of implementing a nip width broad enough to enhance a fixing ability. The fixing unit can therefore adapt itself to high-speed image formation.

Various modifications will become possible for those skilled in the art after receiving the teachings of the present disclosure without departing from the scope thereof.

What is claimed is:

1. A tandem image forming device comprising: a plurality of image forming sections arranged side by side and each comprising a developing device and a cleaning device arranged around an image carriers;

one of nearby ones of said plurality of image forming sections having said cleaning device thereof positioned above said developing device of other image forming sections; and said developing device including an agitating section and a developing section, said agitating section being positioned at a lower level than the developing section with said cleaning device overlying said agitating section.

2. An image forming apparatus comprising:

an intermediate image transfer body implemented as a belt;

a tandem image forming device comprising a plurality of image forming sections arranged side by side in a direction in which said intermediate image transfer body extends, said plurality of image forming sections each comprising a developing device and a cleaning device arranged around an image carrier;

one of nearby ones of said plurality of image forming sections having said cleaning device thereof positioned above said developing device of other image forming sections; and said developing device including an agitating section and a developing section, said agitating section being positioned at a lower level than the developing section with said cleaning device overlying said agitating section.

3. The apparatus as claimed in claim 2, wherein said plurality of image forming sections are distributed above and below said intermediate image transfer body.

4. The apparatus as claimed in claim 3, further comprising a transfer body cleaning device positioned above said developing device included in one image forming device that is located at an end.

5. The apparatus as claimed in claim 4, wherein said image forming sections each further comprises a primary image transfer device.

6. The apparatus as claimed in claim 5, further comprising a controller for outputting an emergency stop command when an error occurs.

7. The apparatus as claimed in claim 6, further comprising bias applying means for applying, from a time when said controller outputs the emergency stop command to a time when said transfer body cleaning device removes toner already transferred to said intermediate image transfer body, a bias to a downstream, primary image transfer device for causing said toner to move from said image carrier to said intermediate image transfer body.

8. The apparatus as claimed in claim 7, wherein said bias applying means comprises primary image transfer bias forming means for forming a primary image transfer bias at said primary image transfer device to thereby effect primary transfer of a toner image from said image carrier to said intermediate image transfer body.

9. The apparatus as claimed in claim 8, wherein said intermediate image transfer body comprises an elastic layer and a smooth coating layer covering a surface of said elastic layer.

10. The apparatus as claimed in claim 9, wherein said elastic layer is not flexible in a circumferential direction of said intermediate image transfer body, but is elastic at at least a surface thereof and subjected to a pressure by secondary transfer.

11. The apparatus as claimed in claim 10, comprising a secondary image transfer device configured to transfer the toner image from said intermediate image transfer body to a recording medium and positioned below a range over which said intermediate image transfer body extends.

12. The apparatus as claimed in claim 11, comprising a fixing device entirely or partly positioned below said range and configured to fix the toner image transferred to the recording medium.

13. The apparatus as claimed in claim 12, wherein said secondary image transfer device comprises an endless belt playing the role of a conveyor for conveying the recording medium to said fixing device at a same time.

14. The apparatus as claimed in claim 11, wherein said said intermediate image transfer body extends over a length smaller than a length of said tandem image forming device, as measured in the direction in which said intermediate image transfer body extends.

15. The apparatus as claimed in claim 2, further comprising a transfer body cleaning device positioned above said developing device included in one tandem image forming device that is located at an end.

16. The apparatus as claimed in claim 15, wherein said image forming sections each further comprise a primary image transfer device.

17. The apparatus as claimed in claim 16, further comprising a controller configured to output an emergency stop command when an error occurs.

18. The apparatus as claimed in claim. 17, further comprising bias applying means for applying, from a time when said controller outputs the emergency stop command to a time when said transfer body cleaning device removes toner already transferred to said intermediate image transfer body, a bias to a downstream, primary image transfer device for causing said toner to move from said image carrier to said intermediate image transfer body.

19. The apparatus as claimed in claim 18, wherein said bias applying means comprises primary image transfer bias forming means for forming a primary image transfer bias at said primary image transfer device to thereby effect primary transfer of a toner image from said image carrier to said intermediate image transfer body.

20. The apparatus as claimed in claim 19, wherein said intermediate image transfer body comprises an elastic layer and a smooth coating layer covering a surface of said elastic layer.

21. The apparatus as claimed in claim 20, wherein said elastic layer is not flexible in a circumferential direction of said intermediate image transfer body, but is elastic at at least a surface thereof and subjected to a pressure by secondary transfer.

22. The apparatus as claimed in claim 21, comprising a secondary image transfer device positioned below a range over which said intermediate image transfer body extends and configured to transfer a toner image from said intermediate image transfer body to a recording medium.

23. The apparatus as claimed in claim 22, comprising a fixing device entirely or partly positioned below said range and configured to fix the toner image transferred to the recording medium.

24. The apparatus as claimed in claim 23, wherein said secondary image transfer device comprises an endless belt playing the role of a conveyor for conveying the recording medium to said fixing device at a same time.

25. The apparatus as claimed in claim 22, wherein said intermediate image transfer body extends over a length smaller than a length of said tandem image forming device, as measured in the direction in which said intermediate image transfer body extends.

26. The apparatus as claimed in clam 2, further comprising:

a sensor located on a sheet conveyance path configured to sense a leading edge of a recording medium; and a registration roller pair preceding an image transfer position configured to correct a skew of the recording medium.

27. The apparatus as claimed in claim 26, wherein exposure for exposing said image carrier begins on a basis of a time at which said sensor senses the leading edge of the recording medium, and said registration roller pair starts conveying the recording medium to the image transfer position in synchronism with completion of an image forming operation.

28. The apparatus as claimed in claim 27, wherein said sensor comprises a sheet sensor adjoining an outlet of a sheet cassette.

29. The apparatus as claimed in claim 27, wherein said sensor comprises a jam sensor located on the sheet conveyance path at a distance greater than a distance between an exposure position and the image transfer position assigned to said image carrier.

30. The apparatus as claimed in claim 2, further comprising:

a sensor located on a sheet conveyance path and configured to sense a leading edge and a trailing edge of a recording medium; and a registration roller pair preceding an image transfer position and configured to correct a skew of the recording medium.

31. The apparatus as claimed in claim 30, wherein in a repeat print mode, exposure for exposing said image carrier begins on a basis of a time at which said sensor senses the leading edge of a preceding recording medium, a following recording medium begins to be fed in a preselected period of time since said sensor has sensed the trailing edge of the recording medium, and said registration roller pair starts conveying the recording medium to the image transfer position in synchronism with completion of an image forming operation.

32. The apparatus as claimed in claim 31, wherein said sensor comprises a sheet sensor adjoining an outlet of a sheet cassette.

33. The apparatus as claimed in claim 31, wherein said sensor comprises a jam sensor located on the sheet conveyance path at a distance greater than a distance between an exposure position and the image transfer position assigned to said image carrier.

34. The apparatus as claimed in claim 2, further comprising:

a sensor located on a sheet conveyance path and configured to sense a leading edge of a recording medium fed by a feeding operation, which occurs at a preselected interval; and a registration roller pair preceding an image transfer position and configured to correct a skew of the recording medium.

35. The apparatus as claimed in claim 34, wherein in a repeat print mode, exposure for exposing said image carrier begins on a basis of a time at which said sensor senses the leading edge of the recording medium, and said registration roller pair starts conveying the recording medium to the image transfer position in synchronism with completion of an image forming operation.

36. The apparatus as claimed in claim 35, wherein said sensor comprises a sheet sensor adjoining an outlet of a sheet cassette.

37. The apparatus as claimed in claim 35, wherein said sensor comprises a jam sensor located on the sheet conveyance path at a distance greater than a distance between an exposure position and the image transfer position assigned to said image carrier.

38. The apparatus as claimed in claim 2, wherein said image forming sections each form a respective image in a single color, and images formed by said image forming sections are combined to form a composite color image.

39. The apparatus as claimed in claim 2, wherein two image forming sections are arranged side by side and each forms a respective image in a single color, and images formed by said two image forming sections are combined to form a bicolor image.

40. The apparatus as claimed in claim 2, wherein said image forming sections each are entirely or partly constructed into a process cartridge.

41. The apparatus as claimed in claim 2, wherein said developing device uses a two-ingredient type developer including carrier and toner, said agitating section is configured to convey the developer while agitating said developer to thereby deposit said developer on a sleeve, and said developing section is configured to transfer the toner deposited on said sleeve to the image carrier.

42. The apparatus as claimed in claim 41, wherein said agitating section comprises two parallel screws while said developing section comprises said sleeve.

43. The apparatus as claimed in claim 2, wherein use is made of a developer having a weight mean grain size of 4 $\mu$m to 15 $\mu$m.

44. The apparatus as claimed in claim 2, wherein said cleaning device comprises a cleaning blade and a fur brush.

45. The apparatus as claimed in claim 44, wherein said cleaning device further comprises an electric field roller configured to apply a bias to said fur brush.

46. The apparatus as claimed in claim 2, wherein said image forming sections each further comprise a charger configured to charge said image carrier in contact with said image carrier.

47. The apparatus as claimed in claim 2, further comprising a fixing device implemented as an endless belt and configured to fix a toner image formed on a recording medium.

48. The apparatus as claimed in claim 2, further comprising a turning device extending in parallel to said tandem image forming device for turning, in a duplex print mode, a recording medium in order to form a toner image on both sides of said recording medium.

49. An image forming apparatus comprising:

a sheet conveyance path;

a tandem image forming device comprising a plurality of image forming sections arranged side by side along said sheet conveyance path, said plurality of image forming sections each comprising a developing device and a cleaning device arranged around an image carrier;

one of nearby ones of said plurality of image forming sections having said cleaning device thereof positioned above said developing device of other image forming sections; and said developing device including an agitating section and a developing section, said agitating section being positioned at a lower level than the developing section with said cleaning device overlying said agitating section.

50. The apparatus as claimed in claim 49, wherein said image forming sections each form a respective image in a single color, and images formed by said image forming sections are combined to form a composite color image.

51. The apparatus as claimed in claim 49, wherein two image forming sections are arranged side by side and each forms a respective image in a single color, and images formed by said two image forming sections are combined to form a bicolor image.

52. The apparatus as claimed in claim 49, wherein said image forming sections each are entirely or partly constructed into a process cartridge.

53. The apparatus as claimed in claim 49, wherein said developing device uses a two-ingredient type developer including carrier and toner, said agitating section is configured to convey the developer while agitating said developer to thereby deposit said developer on a sleeve, and said developing section is configured to transfer the toner deposited on said sleeve to the image carrier.

54. The apparatus as claimed in claim 53, wherein said agitating section comprises two parallel screws while said developing section comprises said sleeve.

55. The apparatus as claimed in claim 49, wherein use is made of a developer having a weight mean grain size o f 4 $\mu$m to 15 $\mu$m.

56. The apparatus as claimed in claim 49, wherein said cleaning device comprises a cleaning blade and a fur brush.

57. The apparatus as claimed in claim 56, wherein said cleaning device further comprises an electric field roller configured to apply a bias to said fur brush.

58. The apparatus as claimed in claim 49, wherein said image forming sections each further comprise a charger configured to charge said image carrier in contact with said image carrier.

59. The apparatus as claimed in claim 49, further comprising a fixing device implemented as an endless belt and configured to fix a toner image formed on a recording medium.

60. The apparatus as claimed in claim 49, further comprising a turning device extending in parallel to said tandem image forming device and configured to turn, in a duplex print mode, a recording medium in order to form a toner image on both sides of said recording medium.

61. A method of arranging a plurality of image forming sections, each of which comprises a developing device and a cleaning device arranged around an image carrier, comprising:

arranging the plurality of image forming sections side by side in a tandem image forming device, wherein one of nearby ones of said plurality of image forming sections has said cleaning device thereof positioned above said developing device of other image forming sections, and said developing device includes an agitating section and a developing section, said agitating section being positioned below said developing section with said cleaning device overlying said agitating section.

* * * * *